US009034552B2

(12) United States Patent
Iida et al.

(10) Patent No.: US 9,034,552 B2
(45) Date of Patent: May 19, 2015

(54) CARRIER CORE PARTICLES FOR ELECTROPHOTOGRAPHIC DEVELOPER, CARRIER FOR ELECTROPHOTOGRAPHIC DEVELOPER, AND ELECTROPHOTOGRAPHIC DEVELOPER

(75) Inventors: Tomohide Iida, Okayama (JP); Tomoya Yamada, Okayama (JP); Takashi Fujiwara, Okayama (JP)

(73) Assignees: DOWA ELECTRONICS MATERIALS CO., LTD., Tokyo (JP); DOWA IP CREATION CO., LTD., Okayama (JP)

( * ) Notice: Subject to any disclaimer, the term of this patent is extended or adjusted under 35 U.S.C. 154(b) by 0 days.

(21) Appl. No.: 13/641,202

(22) PCT Filed: Mar. 1, 2012

(86) PCT No.: PCT/JP2012/055189

§ 371 (c)(1),
(2), (4) Date: Oct. 15, 2012

(87) PCT Pub. No.: WO2012/124484

PCT Pub. Date: Sep. 20, 2012

(65) Prior Publication Data

US 2013/0344431 A1 Dec. 26, 2013

(30) Foreign Application Priority Data

Mar. 16, 2011 (JP) ..... 2011-057533

(51) Int. Cl.

| | |
|---|---|
| ***G03G 9/113*** | (2006.01) |
| ***G03G 9/10*** | (2006.01) |
| ***G03G 9/107*** | (2006.01) |

(52) U.S. Cl.

CPC ..... *G03G 9/10* (2013.01); *G03G 9/107* (2013.01); *G03G 9/1075* (2013.01); *G03G 9/1131* (2013.01); *G03G 9/113* (2013.01); *G03G 9/1136* (2013.01)

(58) Field of Classification Search

CPC ..... G03G 9/107; G03G 9/113
USPC ..... 430/111.3, 111.31, 111.32, 111.4
See application file for complete search history.

(56) References Cited

FOREIGN PATENT DOCUMENTS

| | | | |
|---|---|---|---|
| EP | 1 239 335 | 9/2002 | |
| EP | 1 522 902 | 4/2005 | |
| JP | 10-198077 | 7/1998 | |
| JP | 2000-170219 | 6/2000 | |
| JP | 2001-027828 | * 1/2001 | ..... G03G 9/113 |
| JP | 2002-296846 | 10/2002 | |
| JP | 2004-133178 | 4/2004 | |

(Continued)

OTHER PUBLICATIONS

Translation of JP 2001-027828 published Jan. 2001.*

(Continued)

*Primary Examiner* — Peter Vajda
(74) *Attorney, Agent, or Firm* — Clark & Brody

(57) ABSTRACT

The carrier core particles for electrophotographic developer have a volume size distribution with a median particle size ranging from 30 μm to 40 μm, the ratio of the carrier core particles having a diameter of 22 μm or lower in the volume size distribution is from 1.0% to 2.0%, the ratio of the carrier core particles having a diameter of 22 μm or lower in a number size distribution is 10% or lower, and the magnetization of the carrier core particles in an external magnetic field of 1000 Oe is from 50 emu/g to 75 emu/g.

5 Claims, 2 Drawing Sheets

(56) References Cited

FOREIGN PATENT DOCUMENTS

| | | | | |
|---|---|---|---|---|
| JP | 2005-314176 | | 11/2005 | |
| JP | 2006-337828 | | 12/2006 | |
| JP | 2008-191322 | | 8/2008 | |
| JP | 2008-241742 | | 10/2008 | |
| JP | 2008-250214 | | 10/2008 | |
| JP | 2008-261955 | | 10/2008 | |
| JP | 2010-055014 | | 3/2010 | |
| JP | 2010-181524 | * | 8/2010 | ..... G03G 9/107 |

OTHER PUBLICATIONS

Translation of JP 2010-181524 published Aug. 2010.*

* cited by examiner

CARRIER CORE PARTICLES FOR ELECTROPHOTOGRAPHIC DEVELOPER, CARRIER FOR ELECTROPHOTOGRAPHIC DEVELOPER, AND ELECTROPHOTOGRAPHIC DEVELOPER

TECHNICAL FIELD

This invention relates to carrier core particles for electrophotographic developer (hereinafter, sometimes simply referred to as "carrier core particles"), carrier for electrophotographic developer (hereinafter, sometimes simply referred to as "carrier"), and electrophotographic developer (hereinafter, sometimes simply referred to as "developer"). More particularly, this invention relates to electrophotographic developer used in copying machines, MFPs (Multifunctional Printers) or other types of electrophotographic apparatuses, carrier core particles and carrier contained in the electrophotographic developer.

BACKGROUND ART

Electrophotographic dry developing systems employed in copying machines, MFPs or other types of electrophotographic apparatuses are categorized into a system using a one-component developer containing only toner and a system using a two-component developer containing toner and carrier. In either of these developing systems, toner charged to a predetermined level is applied to a photoreceptor. An electrostatic latent image formed on the photoreceptor is rendered visual with the toner and is transferred to a sheet of paper. The image visualized by the toner is fixed on the paper to obtain a desired image.

A brief description about development with the two-component developer will be given. A predetermined amount of toner and a predetermined amount of carrier are accommodated in a developing apparatus. The developing apparatus is provided with a rotatable magnet roller with a plurality of south and north poles alternately arranged thereon in the circumferential direction and an agitation roller for agitating and mixing the toner and carrier in the developing apparatus. The carrier made of a magnetic powder is carried by the magnet roller. The magnetic force of the magnet roller forms a magnetic brush, which is also called straight-chain like bristles. Agitation produces triboelectric charges that bond a plurality of toner particles to the surfaces of the carrier particles. The magnetic brush abuts against the photoreceptor with rotation of the magnet roller to supply the toner to the surface of the photoreceptor. Development with the two-component developer is carried out as described above.

The recently dominating carrier includes carrier core particles that are the core, or the heart of the carrier particles, and coating resin that covers the outer surface of the carrier core particles. The carrier, which is a component of the two-component developer, is required to have various functions including: a function of triboelectrically charging the toner by agitation in an effective manner; a toner transferring ability to appropriately transfer and supply the toner to the photoreceptor; and an improved charge transfer rate at which residual charge on the carrier surface after toner has been transferred to a photoreceptor is leaked.

The carrier in the developing apparatus is carried by the magnetic force of the magnet roller. In such usage, as the retentivity of the carrier to the magnet roller decreases, so-called carrier scattering occurs, or more specifically, the carrier scatters toward the photoreceptor, resulting in adhesion of the carrier on paper where an image is formed.

Technologies to prevent the carrier scattering are disclosed in Japanese Unexamined Patent Application Publication Nos. 2002-296846 (PTL 1) and 2008-191322 (PTL 2).

In the carrier for electrophotographic developer according to PTL 1, the volume mean diameter of spherical magnetic carrier core particles is 25 to 45 μm, the mean pore size of the carrier particles is from 10 to 22 μm, the ratio of particles having a diameter of 22 μm or lower based on a volume size distribution measurement is less than 1%, the magnetization in a magnetic field of 1 kOe is 67 to 88 emu/g, and the difference in magnetization between scattered carrier particles and original carrier particles in a magnetic field of 1 kOe is 10 emu/g or lower. The carrier having such compositions can prevent image degradation caused by hardening of the bristles of the magnetic brush, as well as carrier scattering.

PTL 2 discloses carrier for two-component type electrophotographic developer invented to make the magnetic brush flexible to mitigate the adhesion of the carrier to paper and improve the tone reproducibility of images. To achieve such carrier, the volume mean diameter of the carrier particles is set to 15 μm to 40 μm, the ratio of carrier particles having a diameter less than 22 μm is set to 1.0% or more, the fluidity of the carrier particles is set to 30 sec/50 g to 40 sec/50 g, and the apparent density of the carrier particles is set to 2.20 g/cm$^3$ to 2.50 g/cm$^3$.

CITATION LIST

Patent Literature

PTL 1: JP-A No. 2002-296846
PTL 2: JP-A No. 2008-191322

SUMMARY OF INVENTION

Technical Problem

PTL 2 suggests that the carrier particles composed as described above can mitigate the carrier adhesion and enhance the tone reproducibility of images.

By the way, recent multifunctional machines, including copying machines and printers, have been increasingly required to meet demands for higher quality as well as longer life and faster speeds. Of course, these demands have risen on developer used to form images with the multifunctional machines. In short, the developer is required to have carrier that does not scatter during the process of development, while satisfing the demands for higher quality, longer life and faster speeds. However, the developer that contains the carrier composed to meet the requirements specified in PTL 2 may not be able to cope with the needs.

The present invention has an object to provide carrier core particles for electrophotographic developer capable of providing high image quality and longevity as well as more reliable reduction of carrier scattering.

The present invention has another object to provide carrier for electrophotographic developer capable of providing high image quality and longevity as well as more reliable reduction of carrier scattering.

The present invention has yet another object to provide electrophotographic developer capable of providing high image quality and longevity as well as more reliable reduction of carrier scattering.

Solution to Problem

The inventors of the present invention conceived that the requirement specified in PTL 2 is not enough to achieve carrier of developer used in multifunctional machines that have been developed to meet the recent demands for higher speed developing process and longer life. Specifically, for example, high-speed machines that supply a larger amount of developer per unit time are designed to rotate their development rollers at a higher rate. In addition, recently, there is a trend to make toner particles smaller to meet the demand for forming high quality images, and accordingly, there is a trend to make carrier particles smaller. Furthermore, formation of over 10 thousands or 20 thousands of images degrades carrier characteristics. The inventors expected that such degraded carrier may scatter during the high-speed development process even though conventional carrier does not scatter.

Returning to carrier characteristics, the carrier particles have a particle size distribution with a certain width. In PTL 2, the ratio of the carrier particles having a diameter of 22 μm or lower in a volume size distribution is set to a predetermined range, or specifically set to 1.0% or higher to achieve flexible magnetic brush in order to prevent carrier scattering.

However, the inventors found that if there are many submicroscopic-size carrier particles, for example, during high-speed development or after long-term development, the carrier may scatter even though the ratio of the carrier particles having a diameter of 22 μm or lower in the volume size distribution is in the predetermined range. Then, the inventors have reached a conclusion that the number of the submicroscopic-size carrier particles needs to be controlled to fall in a predetermined range in addition to setting the ratio of the carrier particles having a diameter 22 μm or lower in the volume size distribution into the predetermined range.

The carrier core particles for electrophotographic developer according to the present invention includes a core composition expressed by a general formula: $M_xFe_{3-x}O_4$ ($0 \leq x \leq 1$, M denotes at least one kind of metal selected from the group consisting of Mg, Mn, Ca, Ti, Cu, Zn, Sr and Ni) as a main ingredient. The carrier core particles have a volume size distribution with a median particle size ranging from 30 μm to 40 μm. The ratio of the carrier core particles having a diameter of 22 μm or lower in the volume size distribution is from 1.0% to 2.0%. The ratio of the carrier core particles having a diameter of 22 μm or lower in a number size distribution is 10% or lower. The magnetization of the carrier core particles in an external magnetic field of 1000 Oe is from 50 emu/g to 75 emu/g.

For the purpose of achieving high image quality even in the high speed development or long term usage recently demanded, the inventors first controlled the carrier core particles to have a median particle size in the volume size distribution of from 30 μm to 40 μm to optimize the median particle size in the volume size distribution. For the purpose of enhancing the flexibility of the magnetic brush formed with the carrier, suppressing carrier scattering during the process of high-speed development and carrier scattering after long term usage, and optimizing the magnetic property of the carrier, the inventors have created the carrier core particles having particle size distributions including a volume size distribution with a certain width, and have set the ratio of the carrier core particles having a diameter of 22 μm or lower in the volume size distribution to 1.0% to 2.0%, set the ratio of the carrier core particles having a diameter of 22 μm or lower in a number size distribution to 10% or lower, and set the magnetization of the carrier core particles in an external magnetic field of 1000 Oe to 50 emu/g to 75 emu/g. The carrier core particles thus controlled can provide high image quality and longevity as well as more reliable reduction of carrier scattering.

Preferably, the ratio of the carrier core particles having a diameter of 22 μm or lower in the number size distribution is 8.0% or lower.

More preferably, the ratio of the carrier core particles having a diameter of 22 μm or lower in the number size distribution is 3.0% or higher.

More preferably, the ratio of the carrier core particles having a diameter of 22 μm or lower in the volume size distribution is 1.0% to 1.5%.

In another aspect of the invention, the carrier for electrophotographic developer, which is used to develop electrophotographic images, includes carrier core particles for electrophotographic developer having a core composition expressed by a general formula: $M_xFe_{3-x}O_4$ ($0 \leq x \leq 1$, M denotes at least one kind of metal selected from the group consisting of Mg, Mn, Ca, Ti, Cu, Zn, Sr and Ni) as a main ingredient, and resin that coats the surface of the carrier core particles for electrophotographic developer. The carrier core particles have a volume size distribution with a median particle size ranging from 30 μm to 40 μm. The ratio of the carrier core particles having a diameter of 22 μm or lower in the volume size distribution is from 1.0% to 2.0%. The ratio of the carrier core particles having a diameter of 22 μm or lower in a number size distribution is 10% or lower. The magnetization of the carrier core particles in an external magnetic field of 1000 Oe is from 50 emu/g to 75 emu/g.

In yet another aspect of the invention, electrophotographic developer used to develop electrophotographic images includes carrier and toner that can be triboelectrically charged by frictional contact with the carrier for development of electrophotographic images. The carrier includes carrier core particles having a core composition expressed by a general formula: $M_xFe_{3-x}O_4$ ($0 \leq x \leq 1$, M denotes at least one kind of metal selected from the group consisting of Mg, Mn, Ca, Ti, Cu, Zn, Sr and Ni) as a main ingredient, and a resin that coats the surface of the carrier core particles for electrophotographic developer. The carrier core particles have a volume size distribution with a median particle size ranging from 30 μm to 40 μm. The ratio of the carrier core particles having a diameter of 22 μm or lower in the volume size distribution is from 1.0% to 2.0%. The ratio of the carrier core particles having a diameter of 22 μm or lower in a number size distribution is 10% or lower. The magnetization of the carrier core particles in an external magnetic field of 1000 Oe is from 50 emu/g to 75 emu/g.

Advantageous Effects of Invention

The carrier core particles for electrophotographic developer, carrier for electrophotographic developer and electrophotographic developer can provide high image quality and longevity as well as more reliable reduction of carrier scattering.

DESCRIPTION OF EMBODIMENTS

An embodiment of the present invention will be described below with reference to the drawings. First, carrier core particles according to the embodiment of the invention will be described. The carrier core particles according to the embodiment of the invention are roughly spherical in shape. The diameter and particle size distribution of the carrier core particles according to the embodiment of the invention will be described later. On the surface of the carrier core particles, there are fine asperities that are formed mainly in a firing step, which will be described later.

Carrier particles according to the embodiment of the invention are also roughly spherical in shape as with the carrier core particles. The carrier particles are made by coating, or covering, the carrier core particles with a thin resin film and have almost the same diameter as the carrier core particles. The surfaces of the carrier particles are almost completely covered with resin, which is different from the carrier core particles.

Developer particles according to the embodiment of the invention include the aforementioned carrier particles and toner particles. The toner particles are also roughly spherical in shape. The toner contains mainly styrene acrylic-based resin or polyester-based resin and a predetermined amount of pigment, wax and other ingredients combined therewith. Such toner is manufactured by, for example, a pulverizing method or polymerizing method. The toner particles in use are, for example, about one-seventh of the diameter of the carrier particles. The compounding ratio of the toner and carrier is also set to any value according to the required developer characteristics. Such developer is manufactured by mixing a predetermined amount of the carrier and toner by a suitable mixer.

Figure 1:
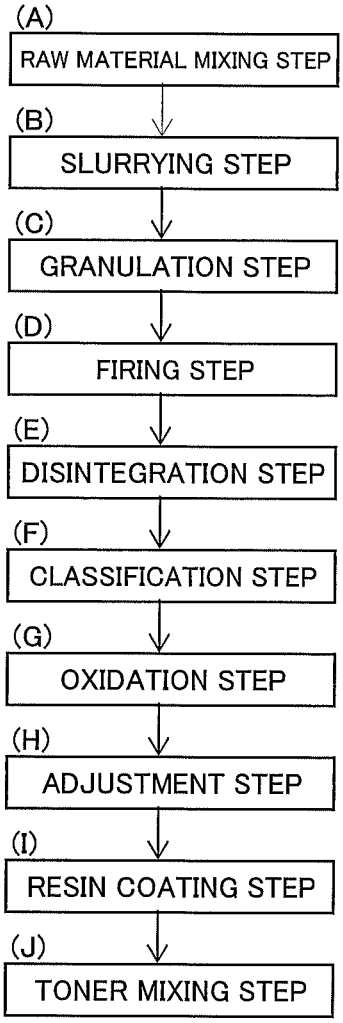
FIG. 1 is a flow chart showing main steps of manufacturing carrier core particles according to an embodiment of the invention.

Next, a method for manufacturing the carrier core particles according to the embodiment of the invention will be described. FIG. 1 is a flow chart showing main steps of the method for manufacturing the carrier core particles according to the embodiment of the invention. Along FIG. 1, the method for manufacturing the carrier core particles according to the embodiment of the invention will be described below.

First, a raw material containing iron and a raw material containing manganese are prepared. The prepared raw materials are formulated at an appropriate compounding ratio to meet the required characteristics, and mixed (FIG. 1(A)). The appropriate compounding ratio in this embodiment is set so that the resultant carrier core particles are made at the compounding ratio.

The iron raw material making up the carrier core particles according to the embodiment of the invention can be metallic iron or an oxide thereof, and more specifically, preferred materials include $Fe_2O_3$, $Fe_3O_4$ and Fe, which can stably exist at room temperature and atmospheric pressure. The manganese raw material can be manganese metal or oxide thereof, and more specifically, preferred materials include Mn metal, $MnO_2$, $Mn_2O_3$, $Mn_3O_4$ and $MnCO_3$, which can stably exist at room temperature and atmospheric pressure. Alternative raw material may be made up by calcinating each of the aforementioned raw materials (iron raw material, manganese raw material, etc.) or the raw materials mixed so as to have target composition and pulverizing the calcinated materials. The carrier core particles in this description can include a core composition expressed by a general formula: $M_xFe_{3-x}O_4$ ($0 \leq x \leq 1$, M denotes at least one kind of metal selected from the group consisting of Mg, Mn, Ca, Ti, Cu, Zn, Sr and Ni) as a main ingredient.

Next, the mixed raw materials are slurried (FIG. 1(B)). In other words, these raw materials are weighed to make a target composition of the carrier core particles and mixed together to make a slurry raw material.

The method for manufacturing the carrier core particles according to the invention requires acceleration of reduction reaction in a part of the firing step, which will be described later. To accelerate reduction reaction, a reduction agent may be further added to the slurry raw material. A preferred reducing agent may be carbon powder, polycarboxylic acid-based organic substance, polyacrylic acid-based organic substance, maleic acid, acetic acid, polyvinyl alcohol (PVA)-based organic substance, or mixtures thereof.

Water is added to the slurry raw material that is then mixed and agitated so as to contain 40 wt % of solids or more, preferably 50 wt % or more. The slurry raw material containing 50 wt % of solids or more is preferable because such a material can maintain the strength when it is granulated into pellets.

Subsequently, the slurried raw material is granulated (FIG. 1(C)). Granulation of the slurry obtained by mixing and agitation is performed with a spray drier. Note that it may be preferable to subject the slurry to wet pulverization before the granulation step.

The temperature of an atmosphere during spray drying can be set to approximately 100° C. to 300° C. This can provide granulated powder whose particles are approximately 10 to 200 μm in diameter. In consideration of the final diameter of the particles as a product, it is preferable to filter the obtained granulated powder by a vibrating sieve or the like to remove coarse particles and fine powder for particle size adjustment at this point of time.

Subsequently, the granulated material is fired (FIG. 1(D)). Specifically, the obtained granulated powder is placed in a furnace heated to approximately 900° C. to 1500° C. and fired for 1 to 24 hours to produce a target fired material. During firing, the oxygen concentration in the firing furnace can be set to any value, but should be enough to advance ferritization reaction. Specifically speaking, when the furnace is heated to 1200° C., a gas is introduced and flows in the furnace to adjust the oxygen concentration to from $10^{-7}$% to 3%.

Alternatively, a reduction atmosphere required for ferritization can be made by adjusting the aforementioned reducing agent. To achieve a reaction speed that provides sufficient productivity in an industrial operation, the preferable temperature is 900° C. or higher. If the firing temperature is 1500° C. or lower, the particles are not excessively sintered and can remain in the form of powder upon completion of firing.

At this stage, the amount of oxygen in the core composition can be controlled to be slightly excessive. One of the possible measures of adding a slightly excessive amount of oxygen in the core composition is to set the oxygen concentration during cooling of the core particles in the firing step to a predetermined value or higher. Specifically, the core particles can be cooled to approximately room temperature in the firing step under an atmosphere at a predetermined oxygen concentration, for example, at an oxygen concentration higher than 0.03%. More specifically, a gas with an oxygen concentration higher than 0.03% is introduced into the electric furnace and continues flowing during the cooling step. This allows the internal layer of the carrier core particle to contain ferrite with an excess amount of oxygen. If the oxygen concentration of the gas is 0.03% or lower in the cooling step, the amount of oxygen in the internal layer becomes relatively low. Therefore, the cooling operation should be performed in an environment at the aforementioned oxygen concentration.

It is preferable at this stage to control the particle size of the fired material. For example, the fired material is coarsely ground by a hammer mill or the like. In other words, the fired granules are disintegrated (FIG. 1(E)). After disintegration, classification is carried out with a vibrating sieve or the like. In other words, the disintegrated granules are classified (FIG. 1(F)). Classifying the granules makes it easier to obtain carrier core particles having a desired size in the latter steps.

Then, the classified granules undergo oxidation (FIG. 1(G)). The surfaces of the carrier core particles obtained at this stage are heat-treated (oxidized) to increase the particle's breakdown voltage to 250 V or higher, thereby imparting an appropriate electric resistance value, from $1\times10^6$ to $1\times10^{13}$ Ω·cm, to the carrier core particles. Increasing the electric resistance of the carrier core particles through oxidation results in reduction of carrier scattering caused by charge leakage.

More specifically, the granules are placed in an atmosphere with an oxygen concentration of 10% to 100%, at a temperature of 200° C. to 700° C., for 0.1 to 24 hours to obtain the oxidized carrier core particles. More preferably, the granules are placed at a temperature of 250° C. to 600° C. for 0.5 to 20 hours, further more preferably, at a temperature of 300° C. to 550° C. for 1 to 12 hours. Note that the oxidation step is optionally executed when necessary.

Next, the carrier core particles oxidized as described above are screened by a vibrating sieve or the like to adjust the median particle size or the like so that the carrier core particles have a volume size distribution with a median particle size ranging from 30 μm to 40 μcm, the ratio of the carrier core particles having a diameter of 22 μm or lower in the volume size distribution is from 1.0% to 2.0%, the ratio of the carrier core particles having a diameter of 22 μm or lower in a number size distribution is 10% or lower, and the magnetization of the carrier core particles in an external magnetic field of 1000 Oe is from 50 emu/g to 75 emu/g (FIG. 1(H)).

More specifically, the oxidized carrier core particles are screened several times by a plurality of sieves having different opening sizes to obtain carrier core particles whose median particle size value in the volume size distribution and magnetization value in an external magnetic field of 1000 Oe fall within the aforementioned range.

In this manner, the carrier core particles according to the embodiment of the invention are obtained. The carrier core particles for electrophotographic developer according to the embodiment of the invention are specifically carrier core particles including a core composition expressed by a general formula: $M_xFe_{3-x}O_4$ ($0\leq x\leq 1$, M denotes at least one kind of metal selected from the group consisting of Mg, Mn, Ca, Ti, Cu, Zn, Sr and Ni) as a main ingredient, wherein the carrier core particles have a volume size distribution with a median particle size ranging from 30 μm to 40 μm, the ratio of the carrier core particles having a diameter of 22 μm or lower in the volume size distribution is from 1.0% to 2.0%, the ratio of carrier core particles having a diameter of 22 μm or lower in the number size distribution is 10% or lower, and the magnetization of the carrier core particles in an external magnetic field of 1000 Oe is from 50 emu/g to 75 emu/g. Such carrier core particles for electrophotographic developer can provide high image quality and longevity as well as more reliable reduction of carrier scattering.

Figure 2:
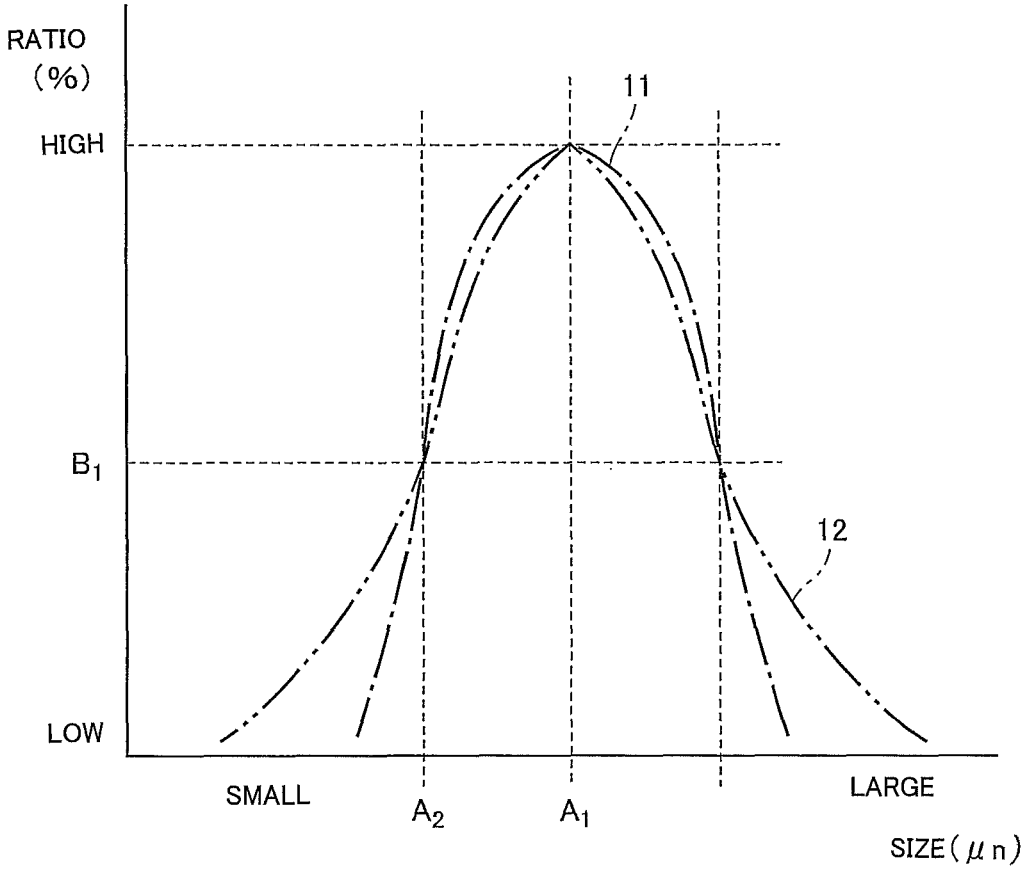
FIG. 2 is a graph showing particle size distributions of carrier core particles.

Brief description will be made about this. FIG. 2 is a graph showing two patterns of volume size distributions of carrier core particles. In FIG. 2, the vertical axis represents ratios (%) in the volume size distribution, while the horizontal axis represents volume diameters (μm).

Referring to FIG. 2, the volume size distribution of carrier core particles indicated by a dot and dash line 11 and the volume size distribution of carrier core particles indicated by a double-dot and dash line 12 have the same median particle size of $A_1$, and also contain smaller particles having a diameter of $A_2$ at the same ratio of $B_1$ in the volume size distributions. However, the two patterns of the volume size distribution have different areas in the field of smaller particles having a diameter of $A_2$ or lower. This shows that the number of the smaller carrier core particles having a diameter of less than $A_2$ is different between the two patterns. More specifically, the graph shows that the number of the carrier core particles indicated by the double-dot and dash line 12 is greater than that of the carrier core particles indicated by the dot and dash line 11. It can be regarded that carrier containing a larger number of small carrier core particles having a diameter of less than $A_2$ forms a magnetic brush of carrier particle groups containing a slightly large number of submicroscopic-size carrier core particles that cannot provide necessary retentivity to retain a magnet roller during high-speed developing process. Such carrier will scatter during the high-speed developing or other processes. To prevent the phenomenon, defining a range in the number size distribution in addition to defining a range in the volume size distribution can provably prevent carrier scattering.

Next, the carrier core particles obtained in the aforementioned manner are coated with resin (FIG. 1(I)). Specifically, the carrier core particles obtained according to the present invention are coated with silicone-based resin, acrylic resin or the like. Finally, carrier for electrophotographic developer according to the embodiment of the invention is achieved. The silicone-based resin, acrylic resin or other coating materials can be coated through a well-known coating method. The carrier for electrophotographic developer according to the embodiment of the invention, which is used to develop electrophotographic images, includes the above-described carrier core particles for electrophotographic developer and resin coating the surface of the carrier core particles for electrophotographic developer. The carrier for electrophotographic developer including the thus-structured carrier core particles can provide high image quality and longevity as well as more reliable reduction of carrier scattering.

Next, the carrier thus obtained and toner in predetermined amounts are mixed (FIG. 1(J)). Specifically, the carrier, which is obtained through the above mentioned manufacturing method, for the electrophotographic developer according to the embodiment of the invention is mixed with an appropriate well-known toner. In this manner, the electrophotographic developer according to the embodiment of the invention can be achieved. The carrier and toner are mixed by any type of mixer, for example, a ball mill. The electrophotographic developer according to the embodiment of the invention is used to develop electrophotographic images and includes the above-described carrier for electrophotographic developer and toner that can be triboelectrically charged by frictional contact with the carrier for development of electrophotographic images. The electrophotographic developer including the thus-structured carrier for electrophotographic developer can provide high image quality and longevity as well as more reliable reduction of carrier scattering.

In the above embodiment, the ratio of the carrier core particles having a diameter of 22 μm or lower in the number size distribution is set to 10% or lower; however, ratio of the carrier core particles having a diameter of 22 μm or lower in the number size distribution can be set to 8.0% or lower. Setting the ratio to 8.0% or lower can achieve carrier core particles that can more reliably provide high image quality and longevity as well as more reliable reduction of carrier scattering.

In addition, in the embodiment, the ratio of the carrier core particles having a diameter of 22 μm or lower in the number size distribution can be set to 3.0% or higher. Setting the ratio to 3.0% or higher can make the magnetic brush flexible in a certain extent. Such carrier core particles can be obtained by screening with a sieve a fewer number of times with an improved yield, thereby bringing down manufacturing cost and providing other merits.

Note that the ratio of the carrier core particles in the number size distribution can be spedified in terms of carrier core particles having a diameter of, for example, 26 μm or lower. More specifically, the ratio of the carrier core particles having a diameter of 22 μm or lower in the number size distribution is set to be 10% or lower; however, the ratio of the carrier core particles having a diameter of 26 μm or lower in the number size distribution can be set to 30% or lower. The carrier can be set to contain carrier core particles at the ratio. Similarly, instead of the ratio of the carrier core particles having a diameter of 22 μm or lower in the number size distribution set to 8.0% or lower, the ratio of the carrier core particles having a diameter of 26 μm or lower in the number size distribution can be set to 25% or lower. The carrier can be set to contain carrier core particles at the ratio.

EXAMPLES 13.7 kg of $Fe_2O_3$ (average particle diameter: 1 μm) and 6.5 kg of $Mn_3O_4$ (average particle diameter: 1 μm) were dispersed in 7.5 kg of water, and 135 g of ammonium polycarboxylate-based dispersant, 68 g of carbon black reducing agent were added to make a mixture. The solid concentration of the mixture was measured and resulted in 75 wt %. The mixture was pulverized by a wet ball mill (median diameter: 2 mm) to obtain mixture slurry.

The slurry was sprayed into hot air of approximately 130° C. by a spray dryer and turned into dried granulated powder. At this stage, granulated powder particles out of the target particle size distribution were removed by a sieve. The remaining granulated powder was placed in an electric furnace and fired at 1130° C. for 3 hours. During firing, gas was controlled to flow in the electric furnace such that the atmosphere in the electric furnace was adjusted to have an oxygen concentration of 0.8%. The obtained fired material was disintegrated and then classified by a sieve, thereby obtaining carrier core particles whose average particle diameter was 35 μm. The obtained carrier core particles were held at 470° C. for 1 hour under atmospheric pressure to be oxidized. The oxidized carrier core particles were screened by a vibrating sieve or the like to adjust the median particle size and so on, resulting in carrier core particles according to Example 1. Carrier core particles of Examples 2 to 8 and Comparative examples 1 to 4 went through the same steps to the adjustment step and have magnetic characteristics and electrical characteristics shown in Table 1.

(Analysis on Mn)

The Mn content in the carrier core particle was quantitatively analyzed in conformity with a ferromanganese analysis method (potential difference titration) shown in JIS G1311-1987. The Mn contents of the carrier core particles described in this invention are quantities of Mn that were quantitatively analyzed through the ferromanganese analysis method (potential difference titration).

For measurement of the volume size distribution and number size distribution, Microtrac Model 9320-X100 produced by NIKKISO CO., LTD. was used.

As to the measurement of magnetization, which exhibits magnetic characteristics, shown in Table 1, magnetic susceptibility was measured with a VSM (Model VSM-P7 produced by Toei Industry Co., Ltd.). The item "$\sigma_{1000}$" indicates magnetization in an external magnetic field of $79.58\times10^3$ (A/m) (1 k (1000) Oe).

Measurement of resistance values will be now described. First, two SUS (JIS) 304 plates each having a thickness of 2 mm and a surface serving as an electrode made by electrolytic grinding were disposed on a horizontally placed insulating plate, or for example an acrylic plate coated with Teflon (trademark), so that the electrodes were spaced 2 mm apart. The two electrode plates were placed so that the normal lines to the plates were along the horizontal direction. After 200±1 mg of powder to be measured was charged in a gap between the two electrode plates, magnets having a cross-sectional area of 240 $mm^2$ were disposed behind the respective electrode plates to form a bridge made of the powder being measured between the electrodes. While keeping the state, DC voltages were applied between the electrodes, and the value of current passing through the powder being measured was measured by a two-terminal method to determine electric resistivity. For the measurement, a super megohmmeter, SM-8215 produced by HIOKI E. E. CORPORATION, was used. The electric resistivity is expressed by a formula: electric resistivity (Ω·cm)=measured resistance value (Ω) multiplied by cross-sectional area (2.4 $cm^2$) divided by interelectrode distance (0.2 cm). With the formula, the resistivity (Ω·cm) with the application of voltages shown in Table 1 was measured. Note that the magnets in use can be anything as long as they can cause the powder to form a bridge. In this embodiment, permanent magnets, for example, ferrite magnets, whose surface magnetic flux density is 1000 gauss or higher were used.

Note that electrical characteristics represented by ER 1000 V in Table 1 indicate values when a voltage of 1000 V was put across the two electrode plates and "BD" denotes "Break Down (immeasurable)".

Before the measurement, silicone resin (SR2411 produced by Dow Corning Toray Co., Ltd.) was diluted with toluene solvent to obtain a silicone resin solution containing 2.0 wt % of silicone resin. Then, alumina was added to the silicone resin solution containing 2.0 wt % of resin to obtain a coating resin solution that was then loaded to an immersion type coating machine. The carrier core particles obtained above were heated and then agitated at 240° C. for two hours with the coating resin solution in the coating machine, resulting in carrier according to Example 1.

The carrier and toner of approximately 5 μm in diameter were mixed for a predetermined time period by a pot mill to obtain two-component type electrophotographic developer according to Example 1. The two-component type electrophotographic developer was tested with a digital reversal development type test machine operable at a copy speed of 60 copies per minute to evaluate carrier scattering and image quality. Carrier and electrophotographic developer of Examples 2 to 8 and Comparative examples 1 to 4 were obtained through the same manner.

(1) Evaluation of Carrier Scattering:

With the 60-PPM test machine, the two-component electrophotographic developers were evaluated in terms of carrier scattering. Specifically, the carrier scattering (white spots) present on an image was ranked on three levels as follows. The results are shown in Table 1.

Excellent: a level in which there are no white spots on 10 sheets of A3-size paper.

Fair: a level in which there are 1 to 10 white spots on each of 10 sheets of A3-size paper.

Poor: a level in which there are 11 or more white spots on each of 10 sheets of A3-size paper.

(2) Image Quality:

With the 60-PPM test machine, the two-component electrophotographic developers were evaluated in terms of image quality and the image quality was ranked on three levels as follows. The results are shown in Table 1.

Excellent: test image was excellently reproduced.

Fair: test image was fairly reproduced.

Poor: test image was not reproduced at all.

[Table 1]

TABLE 1

| | VOLUME SIZE DISTRIBUTION | | NUMBER SIZE DISTRIBUTION | MAGNETIC CHARACTERISTICS | ELECTRICAL CHARACTERISTICS | ACTUAL MACHINE PERFORMANCE (INITIAL STAGE) | | ACTUAL MACHINE PERFORMANCE (10K) | |
|---|---|---|---|---|---|---|---|---|---|
| | MEDIAN PARTICLE DIAMETER μm | 22 μm OR LOWER % | 22 μm OR LOWER % | $\sigma_{1000}$ $Am^2/kg$ | ER1000V Ω · cm | CARRIER SCATTERING | IMAGE QUALITY | CARRIER SCATTERING | IMAGE QUALITY |
| EXAMPLE 1 | 34.65 | 1.35 | 5.72 | 69.3 | 1.3E+07 | EXCELLENT | EXCELLENT | EXCELLENT | EXCELLENT |
| EXAMPLE 2 | 34.43 | 1.74 | 7.71 | 69.1 | 8.5E+06 | FAIR | EXCELLENT | EXCELLENT | EXCELLENT |
| EXAMPLE 3 | 34.98 | 1.03 | 4.08 | 70.2 | 1.2E+07 | EXCELLENT | EXCELLENT | EXCELLENT | EXCELLENT |
| EXAMPLE 4 | 34.78 | 1.19 | 5.71 | 69.9 | 1.0E+07 | EXCELLENT | EXCELLENT | EXCELLENT | EXCELLENT |
| EXAMPLE 5 | 39.60 | 1.13 | 3.30 | 67.3 | 4.6E+06 | EXCELLENT | EXCELLENT | EXCELLENT | EXCELLENT |
| EXAMPLE 6 | 31.90 | 1.87 | 9.76 | 61.9 | B.D. | FAIR | FAIR | FAIR | FAIR |
| EXAMPLE 7 | 34.35 | 1.31 | 6.16 | 70.8 | 9.9E+06 | EXCELLENT | FAIR | EXCELLENT | FAIR |
| EXAMPLE 8 | 35.10 | 1.05 | 4.31 | 53.2 | 3.4E+07 | FAIR | FAIR | FAIR | EXCELLENT |
| COMPARATIVE EXAMPLE 1 | 34.70 | 2.21 | 11.68 | 68.7 | 8.3E+06 | POOR | FAIR | POOR | FAIR |
| COMPARATIVE EXAMPLE 2 | 34.12 | 0.95 | 2.12 | 69.3 | 1.3E+07 | FAIR | POOR | FAIR | FAIR |
| COMPARATIVE EXAMPLE 3 | 31.90 | 1.82 | 10.76 | 61.2 | B.D. | POOR | FAIR | POOR | FAIR |
| COMPARATIVE EXAMPLE 4 | 41.10 | 1.03 | 2.27 | 48.3 | 8.6E+06 | POOR | POOR | POOR | POOR |

Table 1 shows that the carrier core particles of Examples 1 to 8 have distributions and characteristics within the aforementioned ranges. Specifically, the carrier core particles of Examples 1 to 8 have volume size distributions with a median particle size in a range from 30 μm to 40 μm, the ratios of the carrier core particles having a diameter of 22 μm or lower in the volume size distributions are from 1.0% to 2.0%, the ratios of the carrier core particles having a diameter of 22 μm or lower in the number size distribution are 10% or lower, and the magnetization values of the carrier core particles in an external magnetic field of 1000 Oe are from 50 emu/g to 75 emu/g. In the performance by an actual machine, the carrier core particles do not cause carrier scattering, but provide good image quality both at the initial operation stage and after printing 10 K (K: 1000) sheets of paper.

On the contrary, the carrier core particles of Comparative example 1 contain 2.21% particles having a diameter of 22 μm or lower in the volume size distribution, and contain 11.68% particles having a diameter of 22 μm or lower in the number size distribution. The carrier core particles of Comparative example 2 contain 0.95% particles having a diameter of 22 μm or lower in the volume size distribution. The carrier core particle of Comparative example 3 contains 10.76% particles having a diameter of 22 μm or lower in the number size distribution. The carrier core particles of Comparative example 4 have a volume size distribution with a median particle size of 41.10 μm and magnetization of 48.3 emu/g in an external magnetic field of 1000 Oe.

The developers of Comparative examples 1 to 4 have at least a performance problem in carrier scattering or image quality at the initial operation stage or after 10 K (K: 1000)-sheet printing.

With the structure described above, the carrier core particles, carrier and electrophotographic developer according to the invention can provide high image quality and longevity as well as more reliable reduction of carrier scattering.

Although iron and manganese are employed as the raw materials contained in the carrier core particles in the aforementioned embodiment, the raw material may further include magnesium and calcium. More specifically, as described above, the carrier core particles include a core composition expressed by a general formula: $M_xFe_{3-x}O_4$ ($0 \leq x \leq 1$, M denotes at least one kind of metal selected from the group consisting of Mg, Mn, Ca, Ti, Cu, Zn, Sr and Ni) as a main ingredient.

A preferable example of the raw material containing magnesium to be added is magnesium metal or oxide thereof. More specifically, for example, $MgCO_3$, which is magnesium carbonate, $Mg(OH)_2$, which is magnesium hydroxide, and MgO, which is magnesium oxide, are preferable. In a specific example when adding such ingredients, for example, 2.3 kg of $MgFe_2O_4$ (average particle diameter: 3 μm), in addition to 13.7 kg of $Fe_2O_3$ (average particle diameter: 1 μm), 6.5 kg of $Mn_3O_4$ (average particle diameter: 1 μm), is dispersed in 7.5 kg of water. The carrier core particles containing magnesium in addition to manganese and iron have a magnetization value of approximately 52 emu/g to 54 emu/g in an external magnetic field of 1000 Oe.

The content of Mg, Ca or other ingredients is analyzed as follows.

(Analysis on Mg and Ca)

The carrier core particles of the invention were dissolved in an acid solution and quantitatively analyzed with ICP to determine the contents of Mg and Ca. The contents of Mg and Ca in the carrier core particles described in this invention are quantities of Mg and Ca that were quantitatively analyzed with the ICP.

Regarding the oxygen amount, the oxygen concentration during the cooling operation in the firing step in this embodiment is set to be higher than a predetermined concentration value in order to add an excess amount of oxygen to the carrier core particles; however, the present invention is not limited thereto. For example, an excess amount of oxygen can be added to the carrier core particles by adjusting the compounding ratio of the raw materials in the mixing step. Alternatively, oxygen can be excessively added to the carrier core particles by performing a step of accelerating the sintering reaction, which is executed before the cooling step, under the same atmosphere as in the cooling step.

The foregoing has described the embodiment of the present invention by referring to the drawings. However, the invention should not be limited to the illustrated embodiment. It should be appreciated that various modifications and changes can be made to the illustrated embodiment within the scope of the appended claims and their equivalents.

INDUSTRIAL APPLICABILITY

The carrier core particles for electrophotographic developer, carrier for electrophotographic developer and electrophotographic developer according to the invention can be effectively used when applied to copying machines or the like that require high speed development, longevity and high image quality.

REFERENCE SIGNS LIST

11, 12: line

The invention claimed is:

1. Carrier core particles for electrophotographic developer comprising a core composition expressed by a general formula: $M_xFe_{3-x}O_4$, wherein $0<x\leq1$, and M denotes at least one kind of metal selected from the group consisting of Mg, Mn, Ca, Ti, Sr, and Ni as a main ingredient, wherein the carrier core particles have a volume size distribution with a median particle size ranging from 30 μm to 40 μm, the ratio of the carrier core particles having a diameter of 22 μm or lower in the volume size distribution is from 1.0% to 2.0%, the ratio of the carrier core particles having a diameter of 22 μm or lower in a number size distribution is between 3% and 10%, and magnetization of the carrier core particles in an external magnetic field of 1000 Oe is from 50 emu/g to 75 emu/g.

2. The carrier core particles for electrophotographic developer according to claim 1, wherein the ratio of the carrier core particles having a diameter of 22 μm or lower in the number size distribution is between 3.0% and 8.0%.

3. The carrier core particles for electrophotographic developer according to claim 1, wherein the ratio of the carrier core particles having a diameter of 22 μm or lower in the volume size distribution is from 1.0% to 1.5%.

4. Carrier for electrophotographic developer used to develop electrophotographic images, comprising:

carrier core particles for electrophotographic developer including a core composition expressed by a general formula: $M_xFe_{3-x}O_4$, wherein $0<x\leq1$, and M denotes at least one kind of metal selected from the group consisting of Mg, Mn, Ca, Ti, Sr, and Ni as a main ingredient, wherein the carrier core particles have a volume size distribution with a median particle size ranging from 30 μm to 40 μm, the ratio of the carrier core particles having a diameter of 22 μm or lower in the volume size distribution is from 1.0% to 2.0%, the ratio of the carrier core particles having a diameter of 22 μm or lower in a number size distribution is between 3% and 10%, and magnetization of the carrier core particles in an external magnetic field of 1000 Oe is from 50 emu/g to 75 emu/g; and resin that coats the surface of the carrier core particles for electrophotographic developer.

5. Electrophotographic developer used to develop electrophotographic images, comprising:

carrier for electrophotographic developer including:

carrier core particles for electrophotographic developer including a core composition expressed by a general formula: $M_xFe_{3-x}O_4$, wherein $0<x\leq1$, and M denotes at least one kind of metal selected from the group consisting of Mg, Mn, Ca, Ti, Sr, and Ni as a main ingredient, wherein the carrier core particles have a volume size distribution with a median particle size ranging from 30 μm to 40 μm, the ratio of the carrier core particles having a diameter of 22 μm or lower in the volume size distribution is from 1.0% to 2.0%, the ratio of the carrier core particles having a diameter of 22 μm or lower in a number size distribution is between 3% and 10%, and magnetization of the carrier core particles in an external magnetic field of 1000 Oe is from 50 emu/g to 75 emu/g; and resin that coats the surface of the carrier core particles for electrophotographic developer; and toner that can be triboelectrically charged by frictional contact with the carrier for development of electrophotographic images.

* * * * *